United States Patent [19]

Premysl

[11] Patent Number: 4,878,669

[45] Date of Patent: Nov. 7, 1989

[54] BINGO CARD MARKER

[76] Inventor: Jaroslav Premysl, 5865 S. 31st St., Milwaukee, Wis. 53221

[21] Appl. No.: 309,733

[22] Filed: Feb. 13, 1989

[51] Int. Cl.[4] ..... A63F 3/06; B43K 27/08

[52] U.S. Cl. ..... 273/148 R; 401/31; 401/35

[58] Field of Search ..... 273/148 R, 269; 401/29, 401/31, 32, 33, 34, 35

[56] References Cited

U.S. PATENT DOCUMENTS 4,238,161 12/1980 Morohashi ..... 401/35

FOREIGN PATENT DOCUMENTS 511356 6/1955 Italy ..... 273/148 R

*Primary Examiner*—Anton O. Oechsle

[57] ABSTRACT

A bingo card stamping device comprising a 5×5 matrix of marker buttons, having individual stamping means attached to the bottom of each button, and which can be set in any pattern desired by the user whereby the user may stamp the pattern on a bingo card.

1 Claim, 3 Drawing Sheets

BINGO CARD MARKER

BACKGROUND OF THE INVENTION

This invention relates to an improvement in stamping apparatus for marking bingo cards.

Bingo, as it is played today, is much more diverse than it used to be. Instead of limiting the winning combinations to a horizonzontal line, vertical line or a diagnal, the combination selected may be any format as, for example, a "T" wherein, to win, the player must cover the top horizontal row and the middle vertical row. Furthermore, the player will typically be playing many cards simultaneously. Since a player is typically faced with several patterns and many cards, it became almost a necessity to identify which pattern is being played on each card. This invention helps to sole this problem by providing a programable stamp which can be used, after programming, to mark a multiplicity of cards in whatever pattern the player needs, with a symbol identifying the cards as those being played by the user.

With reference to FIG. 2, which shows the overall arrangement of the parts of the device, the user presses those buttons corresponding to the pattern to be followed. The lower end of each button has a rubber stamp affixed to it. The symbol used is up to the stamper. Those buttons depressed lock in place until reset thereby providing stamping means for impressing the pattern selected upon multiple cards.

DESCRIPTION OF THE PREFERRED EMBODIMENT

Figure 1:
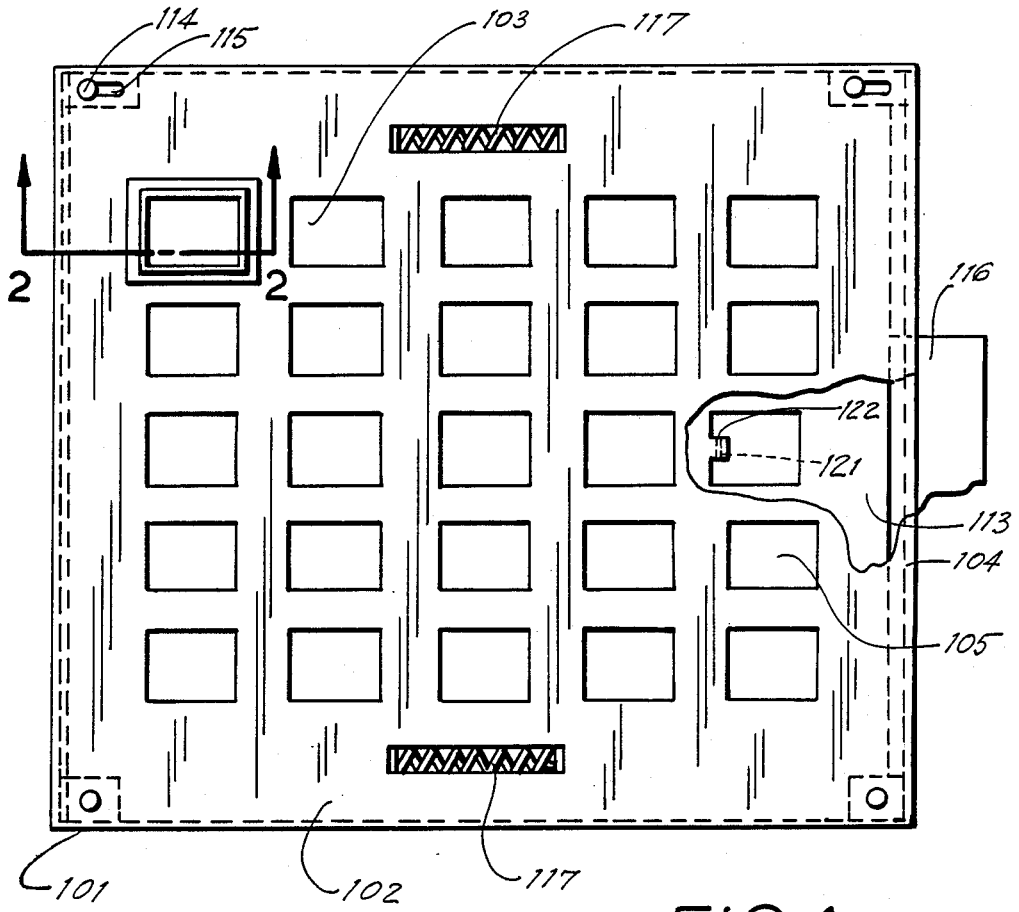
FIG. 1 is a top view of the device showing 1 button in place and a partially cut-away base to show the set-reset plate.

With reference to the figures. In the preferred embodiment, buttons 106 have an upper barrel, 107, a lower barrel, 108, and a cap 109. The cross-section of the upper barrel 107 is generally rectangular as is the cross-section of the lower barrel 108. Furthermore, the width w of the lower barrel 108 is slightly larger than the width w of the upper barrel 107.

Rubber stamp, 112 is attached by any convenient means to the bottom end of lower barrel 108.

The top surface 102 of hollow rectangular base 101 contains a 5×5 matrix of rectangular holes 103. The dimensions of the holes are such that the upper barrel 107 of button 106 will slide therethrough with little play. The spacing of the holes is such that they will be in alignment with each location on a bingo card. Plate 104, which is located parallel to the top surface 102 of base 101, may be affixed to the inside of the base by any convenient means. Plate 104 also has a 5×5 matrix of holes 105 contained within its surface. The dimensions of said holes are such that the lower barrel 108 of button 106 will slide therethrough with little play. The location of holes 105 is such that they are in alignment with each location on a bingo card.

The width of rectangular set-reset plate 113, which may be made of any material which is convenient, such as a plastic material, is slightly less than the width of the interior of top surface 102 of base 101, and the length of plate 113 is slightly less than the length of the interior of surface 102 so that plate 113 may be attached to surface 102 in a manner which permits plate 113 to slide back and forth in the lengthwise direction. In the preferred embodiment rivets 114, which pass through slots 115, provide the slidable attachment means between surface 102 and plate 113.

Extension 116 of plate 113 protrudes from the assembly and provides the means for moving plate 113 to the left at the urging of a user's hand.

Figure 4:
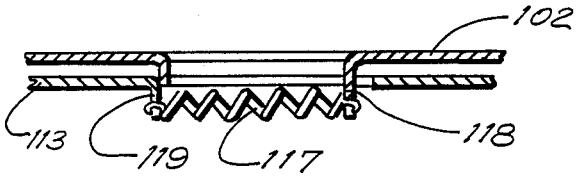
FIG. 4 is a sectional view showing spring means for urging the set-reset plate toward its home position.

Upper and lower spring means 117, one of which is shown in figure 4, is attached, on one end, to ear 118 on base 101, and attached, on the other end to ear 119 on plate 113. Spring means 117 urges plate 113 to the right.

Figure 6:
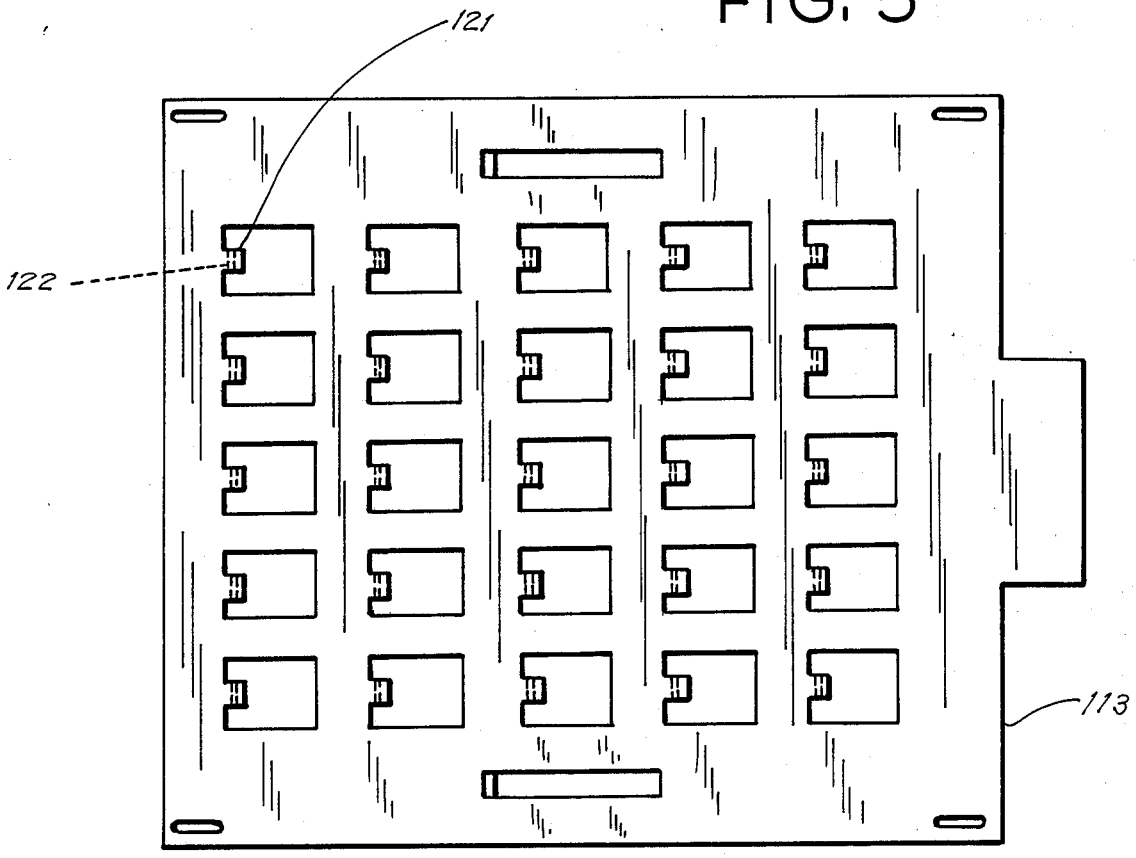
FIG. 6 shows the set-reset plate.
Figure 7:
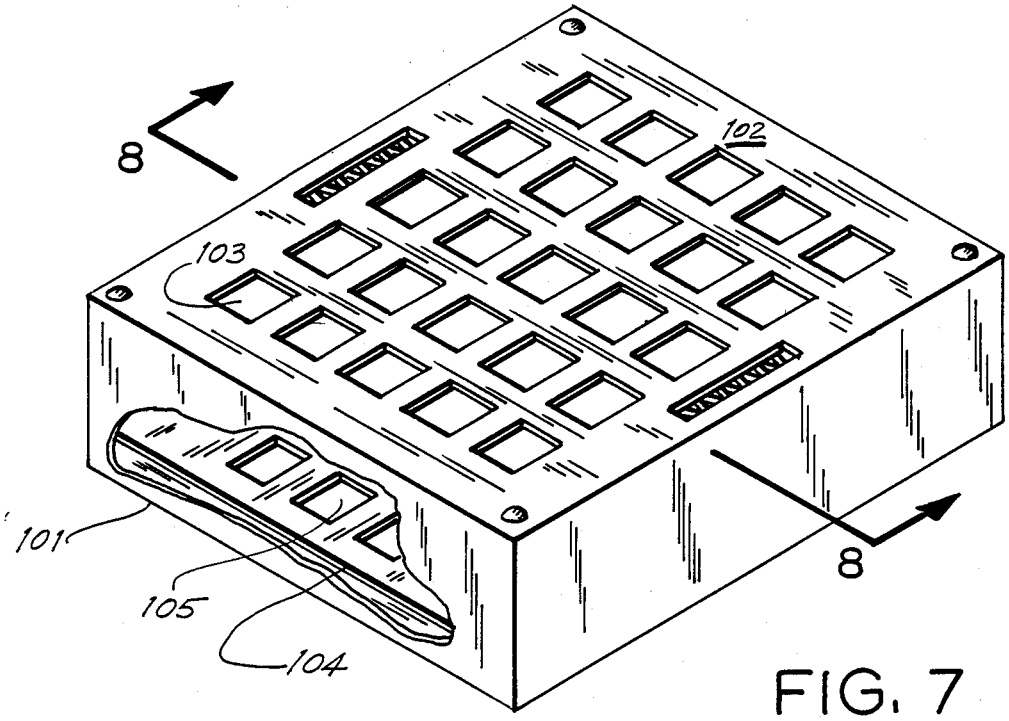
FIG. 7 shows the assembly without buttons or the set-reset plate.
Figure 8:
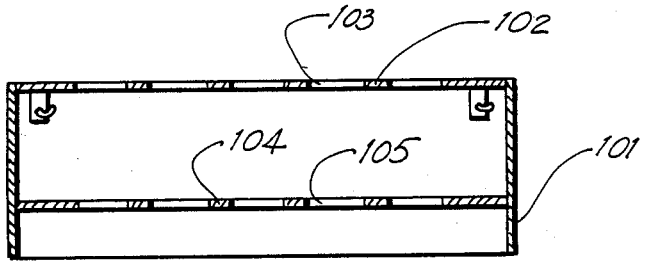
FIG. 8 is a sectional view of the assembly shown in FIG. 7 taken along section line 8-8 in FIG. 7.

Plate 113 contains a 5×5 matrix of rectangular holes 120 which are in alignment with holes 103 and 105 so that buttons 106 may pass therethrough. The depth of hole 120 (FIG. 6) is the same as the depth of hole 103. (FIG. 1). Each position in the matrix has a tab 121 which extends into hole 120 and provides the detent means for locking button 106 in an extended position. The width of holes 120 is such that the upper barrel 107 of button 106 will clear the end of tab 121 when the set-reset plate (113) is pushed to the left.

Figure 2:
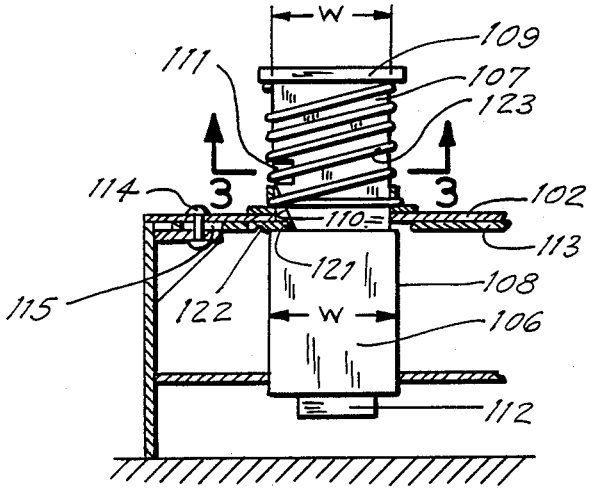
FIG. 2 is a side view of a button in the reset position taken along section line 2—2 in FIG. 1.

Tab 121 contains transverse groove 122. (FIG. 2). The cross-section of the grove may be rectangular, triangular or any other convenient shape so long as the material of the tab is thinned by the groove thereby creating a hinge at the groove which allows tab 121 to pivot and slide up ramp 110 when a button is depressed. When button 106 is depressed, tab 121 will slide up ramp 110, and then up the body of button 106 until tab 121 enters notch 111.

Figure 3:
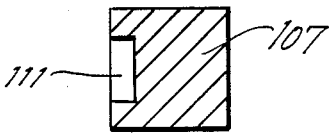
FIG. 3 is a cross-sectional view of a button taken along section line 3—3 in FIG. 2.

Notch 111 may have a rectangular cross-section and extend transversely entirely across upper barrel 107 of button 106 or may be a cavity formed in barrel 107. This form of notch is shown in FIG. 3. In the latter case, the material remaining on either side of the cavity provides a bearing surface which allows button 106 to move freely within holes 103.

Ramp 110, which extends transversely across upper barrel 107 of button 106, may have any convenient slope so long as tab 121 is caused to rotate about hinge point 122.

Spring means 123 surrounds upper barrel 107 and is compressed between cap 109 and surface 102 so that buttons 106 are urged upward at all times.

Figure 5:
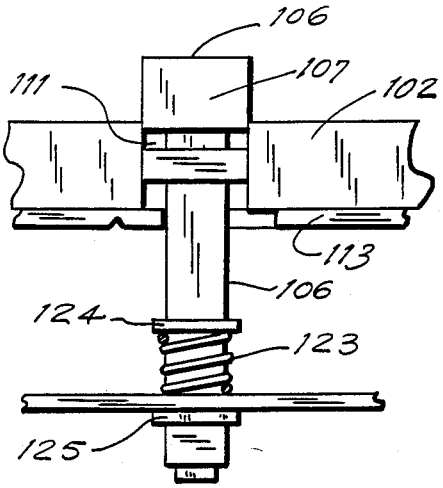
FIG. 5 shows another type of button.

Other forms of this invention are within the contemplation of the inventor. For example, button 106 could comprise several axially aligned cylinders. This form of the button is shown in FIG. 5. A shown therein, upper barrel 107 has a larger diameter than lower barrel 106, ramp 110 has been eliminated, upper surface 102 of base 101 has been thickened to provide a bearing surface which surrounds notch 111. Spring means 123 has been moved so that it surrounds lower barrel 106. Spring retaining clip 124 has been added to hold spring 123 in a compressed state and stop clip 125 has been added to prevent button 106 from moving upward beyond a desired home position.

Other forms of set-reset plate are also within the contemplation of the inventor. Such as for example, making detent tabs 121 of spring steel so that groove 122 may be eliminated, or making set reset plate 113 entirely of spring steel.

What is claimed is:

1. Bingo Card Stamping Apparatus comprising:

a. a hollow rectangular base containing a matrix of rectangular holes in the top thereof which are spaced so that they are in alignment with the locations on a bingo card, the length and width of said holes being any convenient size;

b. a rectangular plate which is affixed to the inside of the hollow rectangular base by any suitable means and is in parallel alignment with the top of the base, the distance between the top of the base and the plate being determined by convenience, said plate containing a matrix of holes which are also in alignment with the locations on a bingo card and are slightly wider and longer than the holes in the base;

c. a rectangular set-reset plate which is in parallel arrangement with and slidably attached to the inside of the top of the base by any convenient means, said set-reset plate having a matrix of rectangular U-shaped holes, the open end of the U being formed by a tab of any convenient shape, which extends into the otherwise rectangular holes on the left side, the length of said holes being slightly greater than the length of the tab plus the length of the holes in the top of the base and the width of said holes being the same as the width of the holes in the base, the set-reset plate having an extension on the right side which provides the means for moving the set-reset plate to the left;

d. spring means attached on one end to the set-reset plate and on the other end to the top of the base for urging the set-reset plate to the right;

e. a plurality of buttons having an upper barrel and a lower barrel, the dimensions of the transverse cross section of the upper barrel of the button being slightly less than the dimensions of the holes in the top of the base so that the upper barrel may slidably pass therethrough, the dimensions of the cross-section of the lower barrel of the button being slightly less than the dimensions of the holes in the rectangular plate so that the lower barrel may slidably pass therethrough, each button having a left side and a right side, the left side of the upper barrel of each button containing a notch which is slightly larger than the tab which projects into the holes in the set-reset plate and which may engage said tab thereby locking a button in a downward position, a ramp on the left side of the upper barrel of each button which may contact the tab and cause the tab to flex in a downward direction in response to downward movement of a button until the tab falls into said notch;

f. stamping means, which is attached to the bottom of the lower barrel of each button; and g. spring means surrounding the barrels of the buttons for urging said buttons to return to an upward position.

* * * * *